US008248189B2

(12) United States Patent
Chen et al.

(10) Patent No.: US 8,248,189 B2
(45) Date of Patent: Aug. 21, 2012

(54) LOW-PASS FILTER

(75) Inventors: Hsin-Ping Chen, Taipei Hsien (TW); Kuang-Wei Cheng, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 899 days.

(21) Appl. No.: 12/336,458

(22) Filed: Dec. 16, 2008

(65) Prior Publication Data

US 2009/0237183 A1 Sep. 24, 2009

(30) Foreign Application Priority Data

Mar. 18, 2008 (CN) ..... 2008 1 0300620

(51) Int. Cl.
*H01P 1/203* (2006.01)

(52) U.S. Cl. ..... 333/204

(58) Field of Classification Search ..... 333/202–205
See application file for complete search history.

(56) References Cited

U.S. PATENT DOCUMENTS

2002/0163405 A1* 11/2002 Miyazaki et al. ..... 333/204
2006/0082424 A1 4/2006 Chang

FOREIGN PATENT DOCUMENTS

TW I280678 5/2007
TW 200740021 A 10/2007
TW 200807796 A 2/2008

* cited by examiner

*Primary Examiner* — Benny Lee
*Assistant Examiner* — Gerald Stevens
(74) *Attorney, Agent, or Firm* — Altis Law Group, Inc.

(57) ABSTRACT

A low-pass filter includes an input portion inputting an electromagnetic signal, an output portion outputting the electromagnetic signal, a high impedance transmission portion electrically connecting the input portion and the output portion to transmit the electromagnetic signal therebetween, and a pair of low impedance transmission members arranged on opposite sides of the high impedance transmission portion. Each of the low impedance transmission members electrically connects the input portion, the output portion, and the high impedance transmission portion, and includes a first low impedance transmission portion and a second low impedance transmission portion. A width of the first low impedance transmission portion is different from that of the second low impedance transmission portion.

4 Claims, 5 Drawing Sheets

LOW-PASS FILTER

BACKGROUND

1. Technical Field

The present disclosure generally relates to filters, and more particularly to a low-pass filter.

2. Description of Related Art

Conventionally, when a wireless network device operates at high power, harmonic components of high frequency are generated due to the nonlinear properties of the active components of the device, causing electromagnetic interference (EMI).

To address this, a filter is often used to suppress the harmonic components. Some manufacturers use a waveguide element, such as a microstrip, formed on a printed circuit board of the device.

Features of an ideal filter are signal attenuation of zero within a pass band, becoming infinite within a stop band, and transition as sharp as possible from the pass band to the stop band, providing the shortest possible distance between a transmission zero point and the stop band. In addition, increased transmission zero points improve performance of the filter in suppression of harmonic noise.

Referring to FIG. 4, a commonly used low-pass filter 40 is shown. The low-pass filter 40 includes an input portion 400, an output portion 420 aligned with the input portion 400, a high impedance transmission portion 440 electrically connected to the input 400 and the output 420, a rectangular first low impedance transmission portion 460 electrically connected to the high impedance transmission portion 440, and a rectangular second low impedance transmission portion 480 parallel to the first low impedance transmission portion 460 and electrically connected to the high impedance transmission portion 440. An overall length of the low-pass filter 40 is 8.69 millimeters (mm), and an overall width of the low-pass filter 40 is 3.53 mm. An area of the low-pass filter 40 is 30.67 $mm^2$.

FIG. 5 is a diagram showing a relationship between amplitude of insertion or return loss and frequency of an electromagnetic signal traveling through the low-pass filter 40. As shown in FIG. 5, only one transmission zero point is generated, therefore the low-pass filter 40 is not effective in the suppression of harmonic noise.

Therefore, a need exists in the industry to overcome the described limitations.

DETAILED DESCRIPTION OF THE EMBODIMENTS

Figure 1:
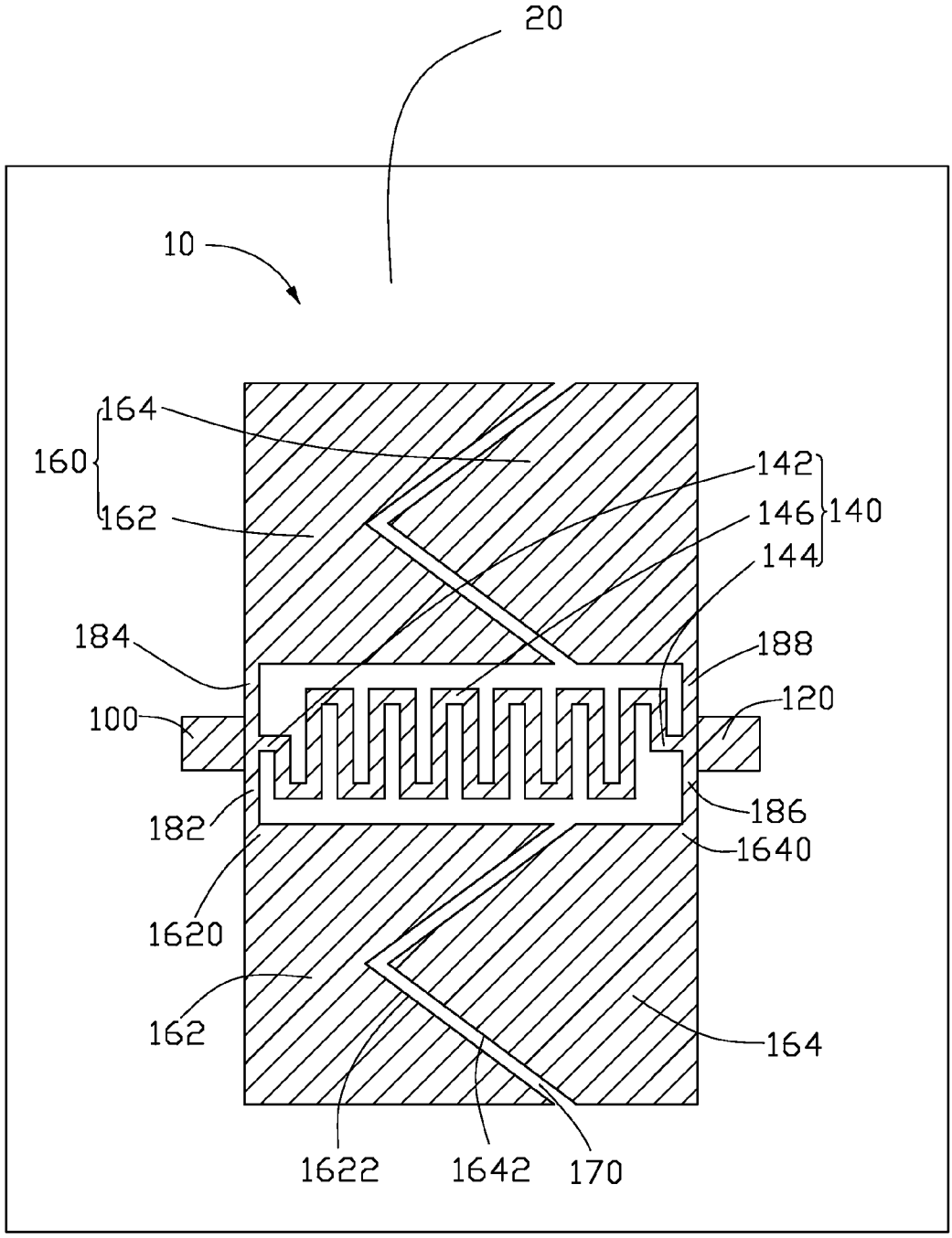
FIG. 1 is a schematic diagram of a low-pass filter of an exemplary embodiment of the disclosure.

FIG. 1 is a schematic diagram of a low-pass filter 10 of an exemplary embodiment of the present disclosure. The low-pass filter 10 is printed on a printed circuit board (PCB) 20, and is a microstrip filter.

The low-pass filter 10 includes an input portion 100, an output portion 120 aligned with the input portion 100, a high impedance transmission portion 140, a pair of rectangular low impedance transmission members 160, a first connecting portion 182, a second connecting portion 184, a third connecting portion 186, and a fourth connecting portion 188.

The input portion 100 inputs electromagnetic signals. The output portion 120 outputs the electromagnetic signals. The input portion 100 and the output portion 120 each have impedance values of approximately 50 ohms (Ω).

The high impedance transmission portion 140 electrically connects the input portion 100 to the output portion 120, transmitting electromagnetic signals therebetween. The high impedance transmission portion 140 is of varied shapes. The high impedance transmission portion 140 comprises a first end portion 142 electrically connected to the input portion 100, a second end portion 144 electrically connected to the output portion 120, and a bent portion 146 between and electrically connecting the first end portion 142 and the second end portion 144. That is, the high impedance transmission portion 140 extends varyingly from the input portion 100 to the output portion 120.

Here, the bent portion 146 is concertinaed. This configuration is also known as a comb-line structure. In this illustrated embodiment, the bent portion 146 is angular, or sharp-cornered. Alternatively, the bent portion 146 may be curved, with rounded corners or portions. Again, the bent portion 146 may be both angular and curved, that is, including a combination of angular corners or portions and curved corners or portions.

In this embodiment, the bent portion 146 reduces the area of the low-pass filter 10.

The low impedance transmission members 160 are located at opposite sides of the high impedance transmission portion 140. Each of the low impedance transmission members 160 comprises a first low impedance transmission portion 162 and a second low impedance transmission portion 164. A slot 170 is formed between the first low impedance transmission portion 162 and the second low impedance transmission portion 164. A width of the first low impedance transmission portion 162 is different from that of the second low impedance transmission portion 164.

The first low impedance transmission portion 162 comprises a third end portion 1620 and a first coupled line 1622. The second low impedance transmission portion 164 comprises a fourth end portion 1640 and a second coupled line 1642 coupled to the first coupled line 1622. The first connecting portion 182 or the second connecting portion 184 electrically connects the third end portion 1620 to the input portion 100 and the first end portion 142. The third connecting portion 184 or the fourth connecting portion 186 electrically connects the fourth end portion 1640 to the output portion 120 and the second end portion 144.

In this embodiment, the slot 170 is V-shaped. Alternatively, the slot 170 can be C-shaped, S-shaped, L-shaped, N-shaped, M-shaped, or W-shaped. That is, the second coupled line 1642 and the first coupled line 1622 have varied shapes, such that coupling capacitance between the first low impedance transmission portion 162 and the second low impedance transmission portion 164 varies.

In this embodiment, an overall length of the low-pass filter 10 is 5.82 mm, and an overall width of the low-pass filter 10 is 3.68 mm. An area of the low-pass filter 10 is 21.42 $mm^2$, 30% less than exemplary low-pass filter 40.

Figure 2:
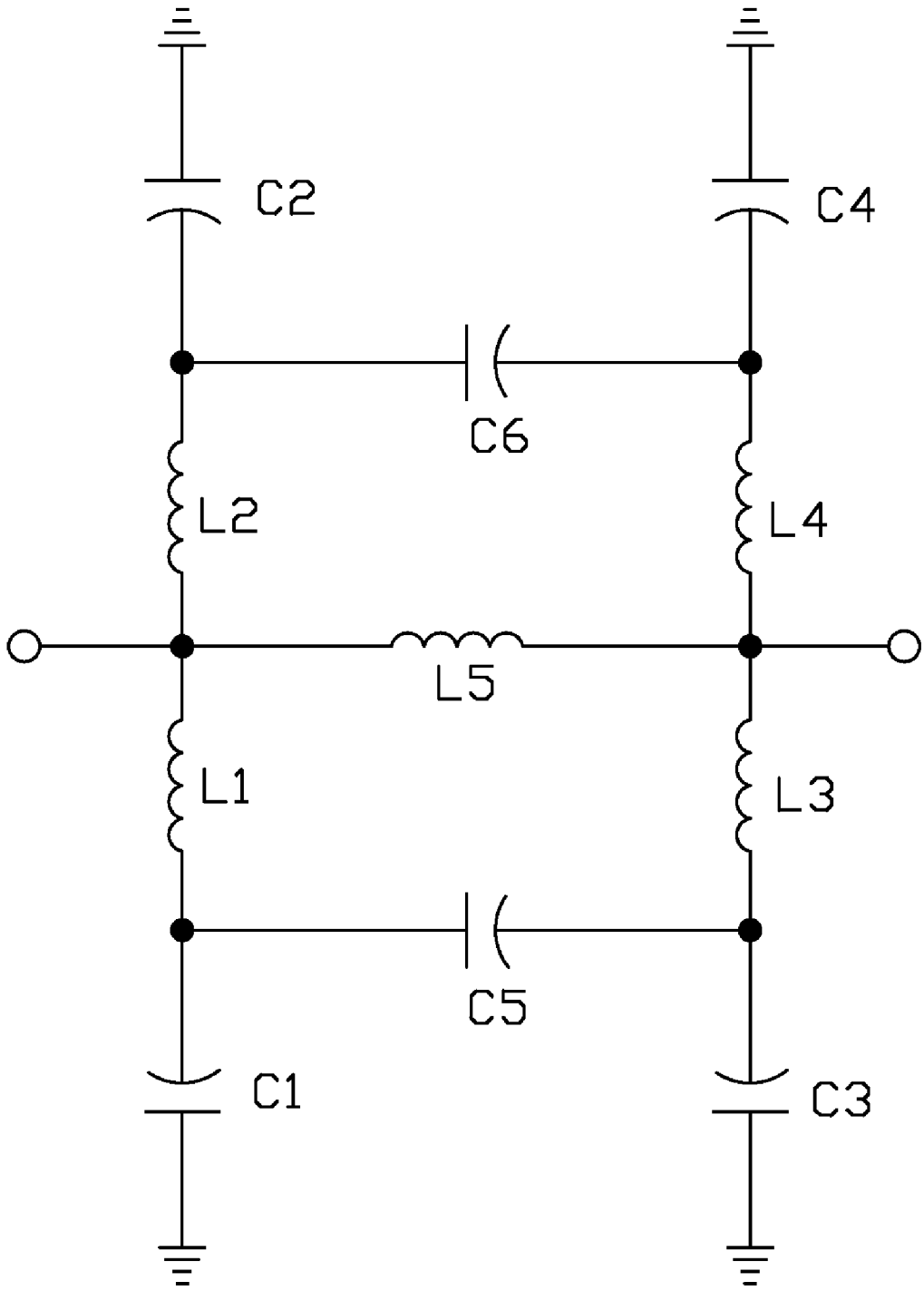
FIG. 2 is a schematic diagram of an equivalent circuit of the low-pass filter of FIG. 1.

FIG. 2 is a schematic diagram of an equivalent circuit of the low-pass filter 10. As shown, the first connecting portion 182, the second connecting portion 184, the third connecting portion 186, and the fourth connecting portion 188 are respectively equivalent to inductors L1, L2, L3, and L4. The high impedance transmission portion 140 is equivalent to an inductor L5. Capacitors C1 and C2 are respectively formed between the two first low-impedance transmission portions 162 and the ground of the PCB 20. Capacitors C3 C4 are formed between the two second low-impedance transmission portions 164 and the ground of the PCB 20. Coupling capacitors C5 and C6 are formed between the two second low-impedance transmission portions 164 and the two first low-impedance transmission portions 162.

Figure 3:
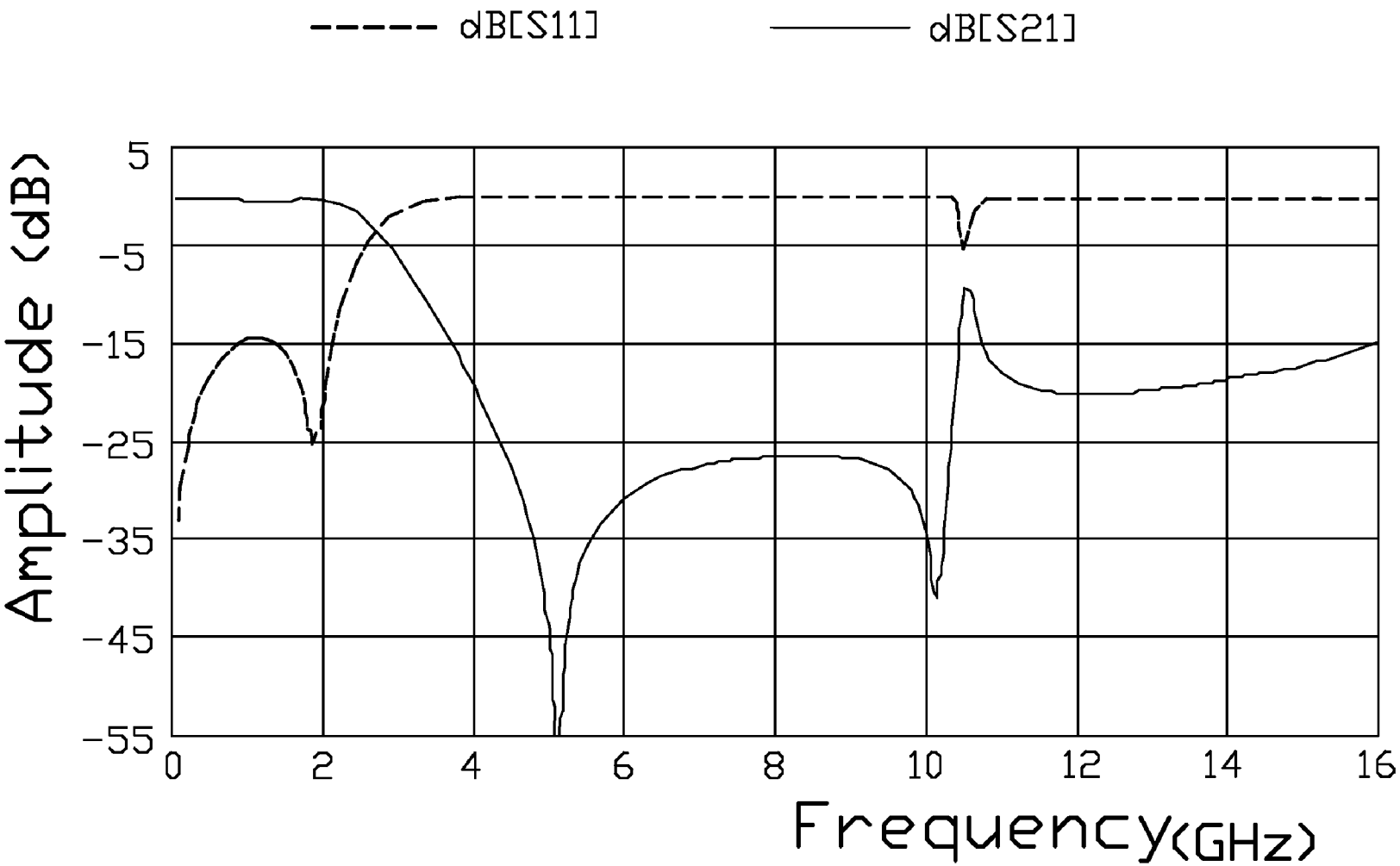
FIG. 3 is a diagram showing a relationship between amplitudes of insertion or return loss and frequency of electromagnetic signals through the low-pass filter of FIG. 1.
Figure 4:
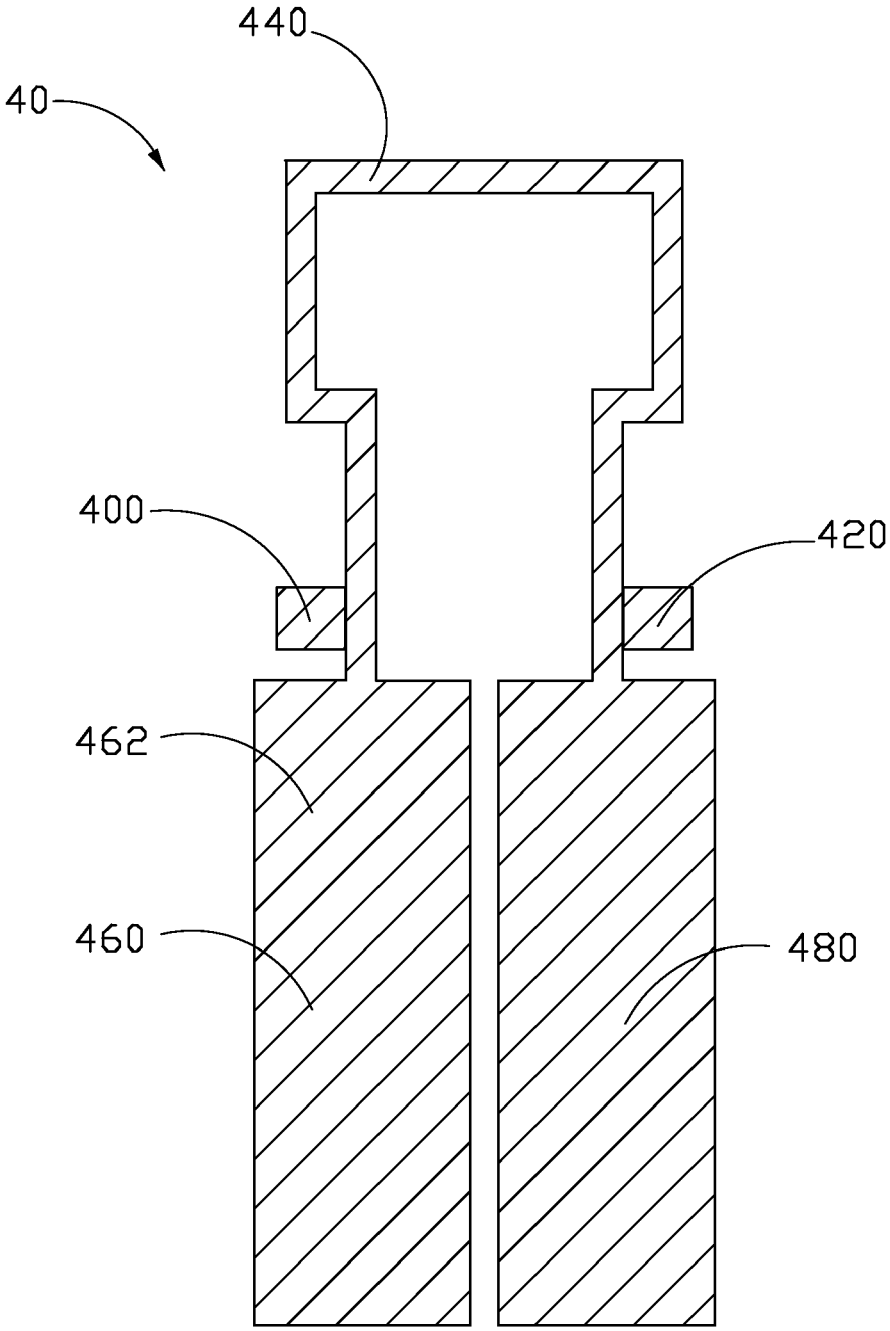
FIG. 4 (RELATED ART)
FIG. 4 is a schematic diagram of a prior low-pass filter.

FIG. 3 is a diagram showing a relationship between amplitudes of insertion or return loss and frequency of an electromagnetic signal through the low-pass filter 10. The horizontal axis represents the frequency in gigahertz (GHz) of the electromagnetic signal traveling through the low-pass filter 10, and the vertical axis represents amplitudes of the insertion or return loss in decibels (dB) of the low-pass filter 10.

In FIG. 3, the insertion loss is represented by a solid line S21, and the return loss is represented by a broken line S11. The curve S21 indicates a relationship between a value of an input power and a value of an output power of the electromagnetic signals traveling through the filter 10, represented by the formula:

$$S21=-10*\text{Log}\ [(\text{Input Power})/(\text{Output Power})].$$

When the electromagnetic signals pass the filter 10, a part of the input power is returned to a source of the electromagnetic signals, defined as a return power. Curve S11 indicates a relationship between the input power and the return power of the electromagnetic signals through the filter 10, and is represented by the formula:

$$S11=-10*\text{Log}\ [(\text{Input Power})/(\text{Return Power})].$$

For a filter, when the output power of the electromagnetic signal in a pass band frequency range approaches the input power of the electromagnetic signal, distortion of the electromagnetic signal is low and performance of the low-pass filter increased, there being an inverse relationship therebetween. As shown by curve S21 of FIG. 3, the absolute value of the insertion loss of the electromagnetic signal in the pass band frequency range is close to 0, indicating that low-pass filter 10 performs well.

Figure 5:
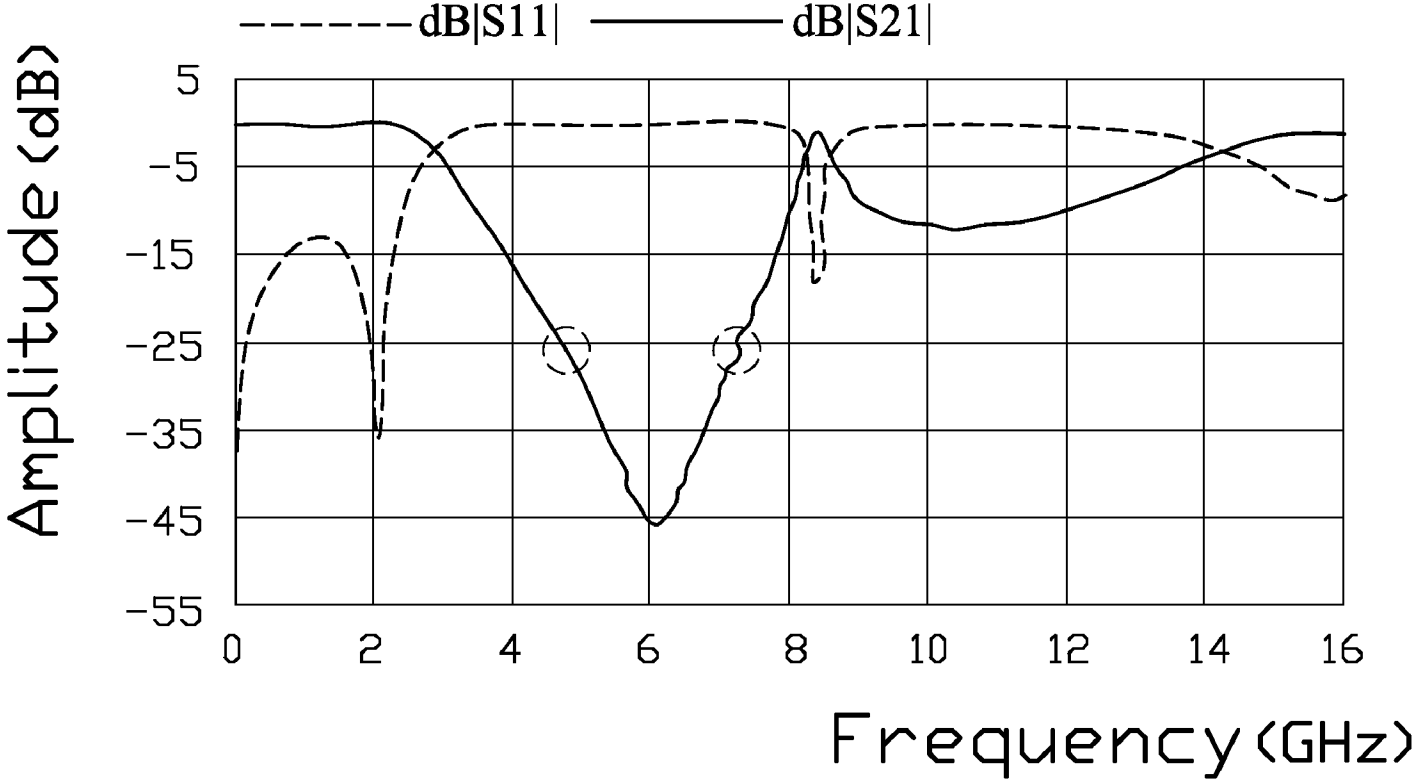
FIG. 5 (RELATED ART)
FIG. 5 is a diagram showing a relationship between amplitude insertion or return loss and frequency of electromagnetic signals through the low-pass filter of FIG. 4.

As shown in FIG. 3, two transmission zero points are generated because the width of the first low impedance transmission portion 162 is different from that of the second low impedance transmission portion 164, so that the low-pass filter 10 can effectively suppress harmonic noise, and the rejection bandwidth of the low-pass filter 20 at −25 dB exceeds 10 GHz. In addition, comparing FIG. 3 with FIG. 5, an attenuation rate of the filter 10 exceeds an attenuation rate of the conventional filter 40. Therefore, filtering by the low-pass filter 10 is improved.

While an embodiment of the present disclosure has been described, it should be understood that it has been presented by way of example only and not by way of limitation. Thus the breadth and scope of the present disclosure should not be limited by the above-described exemplary embodiments, but should be defined only in accordance with the following claims and their equivalents.

What is claimed is:

1. A low-pass filter printed on a printed circuit board, the low-pass filter comprising:

an input portion enabling input of an electromagnetic signal;

an output portion enabling output of the electromagnetic signal;

a high impedance transmission portion electrically connecting the input portion and the output portion to transmit the electromagnetic signal therebetween;

a pair of low impedance transmission members; and a plurality of connecting portions directly connecting each of the input portion and the output portion to the high impedance transmission portion and the pair of low impedance transmission members;

wherein the pair of low impedance transmission members and the plurality of connecting portions surround the high impedance transmission portion.

2. The low-pass filter as recited in claim 1, wherein the pair of low impedance transmission members are symmetrical about the high impedance transmission portion.

3. The low-pass filter as recited in claim 2, wherein each of the pair of low impedance transmission members comprises a first low impedance transmission portion and a second low impedance transmission portion, and the first low impedance transmission portion and the second low impedance transmission portion of each of the pair of low impedance transmission members are asymmetrical.

4. The low-pass filter as recited in claim 1, wherein the high impedance transmission portion comprises a bent portion having an angular concertinaed configuration or a curved concertinaed configuration.

* * * * *